United States Patent [19]

Kühn

[11] 3,945,356

[45] Mar. 23, 1976

[54] COOLED EXHAUST VALVE AND METHODS OF MANUFACTURE THEREOF

[75] Inventor: Karl Walter Kühn, Saint Germain-en-Laye, France

[73] Assignee: Societe d'Etudes de Machines Thermiques, Saint Denis, France

[22] Filed: July 2, 1974

[21] Appl. No.: 485,260

Related U.S. Application Data

[63] Continuation of Ser. No. 304,901, Nov. 9, 1972, abandoned.

[30] Foreign Application Priority Data

Feb. 10, 1972 France ..... 72.04526

[52] U.S. Cl. ..... 123/41.41; 123/41.17

[51] Int. Cl.[2] ..... F01P 3/14

[58] Field of Search ..... 123/41.17, 41.16, 41.41, 123/90.3, 188 A, 188 GC

[56] References Cited

UNITED STATES PATENTS

| | | | |
|---|---|---|---|
| 698,474 | 4/1902 | Ebbs | 123/41.41 |
| 975,255 | 11/1910 | Koven | 123/41.41 |
| 1,415,793 | 5/1922 | Cattaneo | 123/41.41 |
| 1,799,397 | 4/1931 | Taylor | 123/41.17 |
| 1,914,340 | 6/1933 | Holzwarth | 123/41.41 |
| 3,313,277 | 4/1967 | Adolfsson | 123/41.41 |

*Primary Examiner*—Charles J. Myhre
*Assistant Examiner*—Daniel J. O'Connor
*Attorney, Agent, or Firm*—Kenyon & Kenyon Reilly Carr & Chapin

[57] ABSTRACT

Exhaust valve for an internal combustion engine, of the type cooled by fluid circulation and comprising a valve head and a stem screwed into the said head. Said exhaust valve comprises intake and return ducts for the cooling liquid, which are parallel and open into a chamber in the valve head, and which are external relative to one another and substantially symmetrical with respect to the longitudinal axis of the said stem.

19 Claims, 8 Drawing Figures

COOLED EXHAUST VALVE AND METHODS OF MANUFACTURE THEREOF

This is a continuation, of application Ser. No. 304,901 filed Nov. 9, 1972.

The present invention relates to an exhaust valve for an internal combustion engine, of the type cooled of fluid circulation and which comprises a valve head and a stem screwed into the said head, as well as methods of manufacture of such a valve.

The cooled exhaust valves known in the prior art are generally constituted in the following manner: the valve stem is provided with two intake and return ducts for the cooling fluid, which are longitudinal, coaxial and concentric. The internal duct is generally formed by a tube arranged within the external duct. The valve stem is screwed into the valve head and is provided with a blind bore in which is mounted the tube forming the internal duct, the end of which, located on the valve head side, is secured, for instance by welding, either to an externally threaded annular nut which is screwed into the valve stem at its end on the head side, or to a smooth cylindrical end-piece press-fitted into the said stem at its end on the valve head side. In addition, the tube forming the internal duct may be provided with intermediate centring supports against the said bore.

This known configuration of an exhaust valve according to the prior art has several drawbacks, due to the fact that the mounting and fastening of the tube (necessarily made of a special abrasion-resisting steel) forming the internal duct are very delicate. In particular, the welded connections of the internal tube necessitate a very careful carrying out which is therefore expensive and which is indispensable for obtaining a service life and a reliability which are sufficient and compatible with the normal operation of the engine.

In order to remedy the said drawbacks, the invention provides an exhaust valve for an internal combustion engine of the type cooled by fluid circulation and comprising a head and a stem fastened to the said head which comprises a chamber into which open intake and return ducts for the cooling fluid, extending in the said stem in a direction substantially parallel therewith, the said valve being characterized in that the said stem comprises at least two transversely spaced and juxtaposed ducts, for instance symmetrical with respect to the said longitudinal axis.

According to another feature of the invention, the said longitudinal ducts are connected to the outside of the said stem by transverse ducts drilled in the said stem.

The present invention also provides a method of manufacture of the said exhaust valve for an internal combustion engine, of the type cooled by fluid circulation and comprising a head and a stem screwed into the said head, the said method being characterized in that it consists in drilling, in a round bar forming the said stem, at least two ducts substantially parallel with the longitudinal axis of the said bar, respectively for the intake and the return of the said cooling fluid.

According to a variant of the method of the invention, the said round bar forming the valve stem is obtained directly with its two ducts by way of extrusion.

The manufacture of an exhaust valve cooled by liquid circulation is therefore considerably simplified owing to the invention, for it is sufficient to either drill longitudinal parallel ducts in a round bar forming the valve stem, the said stem being obtained for instance by way of machining from a stretched or rolled round bar, or to make the said valve stem directly with its conduits by way of extrusion, which enables the drilling operation to be dispensed with.

The major drawbacks of the valves of the prior art, such as welding difficulties, high costs, risk of defective manufacture, are therefore avoided owing to the exhaust valve according to the invention, which, in addition, has a much simpler configuration readily allowing of several possible alternative embodiments.

The invention will be better understood and other objects, characteristics and advantages thereof will appear as the following description proceeds, with reference to the appended drawings given solely by way of example illustrating several forms of embodiment of the invention and wherein.

Figure 3A:
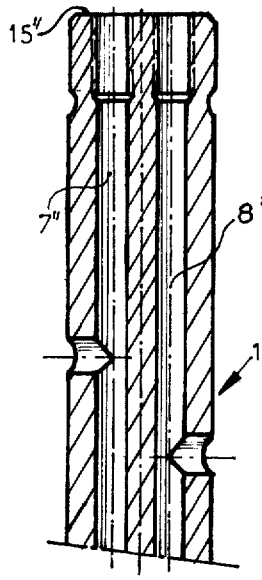
FIG. 3 is a partial sectional view of an alternative embodiment of the invention according to FIG. 1.
Figure 7:
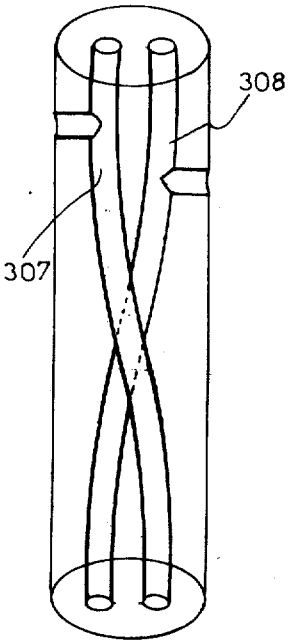
Figure 2:
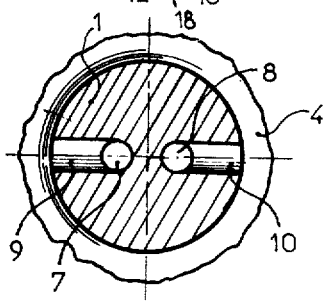
FIG. 2 is a cross-sectional view taken upon the line II—II of FIG. 1.
Figure 3:
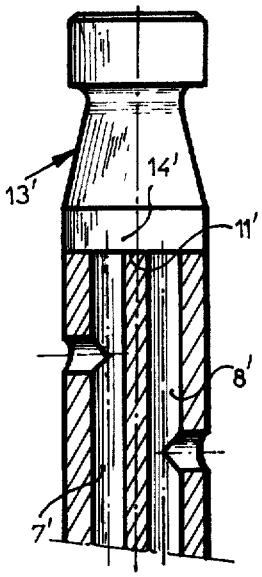
Figure 4:
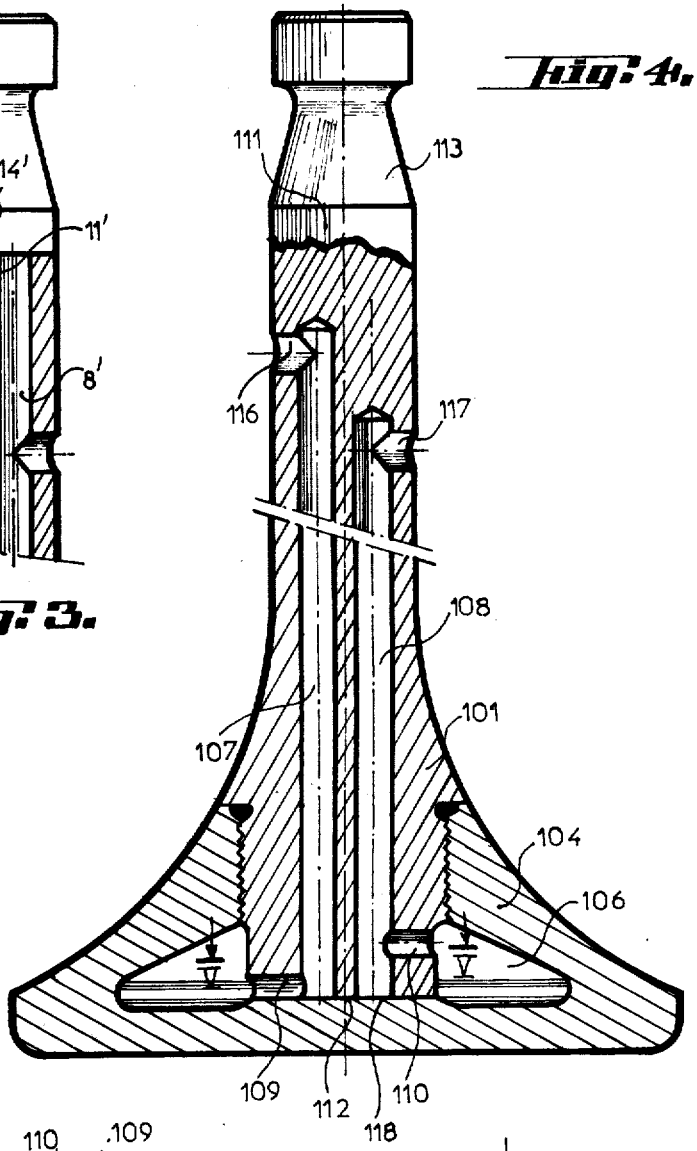
Figure 5:
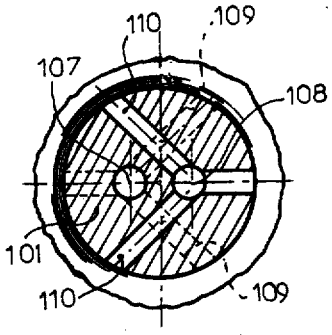
Figure 6:
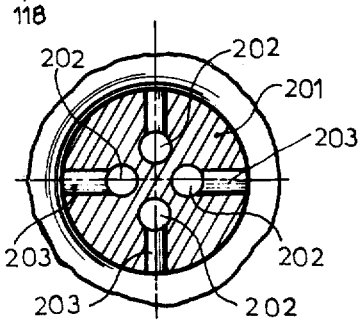

FIG. 3*a* is a fragmentary view similar to FIG. 3, of another modification of the free end of the valve stem;

FIG. 4 is a partial sectional view, partly broken away, of another form of embodiment of the invention, with a valve stem provided with drilled ducts;

FIG. 5 is a cross-sectional view taken upon the line V—V of FIG. 4;

FIG. 6 is a sectional view of a modification of the invention according to FIG. 5;

FIG. 7 is a fragmentary perspective view of another form of embodiment wherein the ducts in the valve stem extend helically about the longitudinal axis of the stem.

The appended figures therefore illustrate exhaust valves according to the invention, of the type cooled by fluid circulation and the stem of which is screwed and brazed in the valve head.

Figure 1:
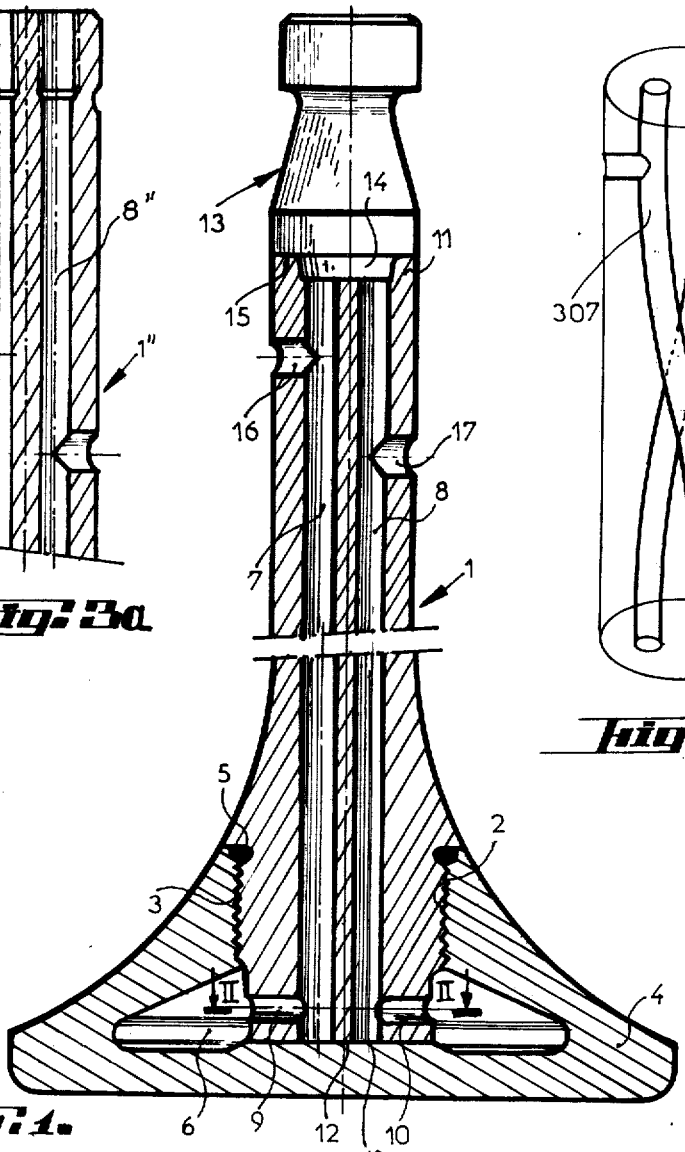
FIG. 1 is a partial sectional view of an exhaust valve according to the invention, the stem of which together with its duct is obtained by way of extrusion.

Referring in particular to FIG. 1, it is seen that the valve comprises a stem designated generally by the reference numeral 1 and one end of which is provided with an external thread 2 co-operating with a corresponding internal thread 3 of the valve head 4. In addition, there is provided a sealing fastening 5 by way of brazing of the valve stem 1 in the valve head 4.

The valve head 4 is also provided with a hollow central chamber or cavity 6 into which penetrates the end of the stem 1 provided with the thread 2. The cavity 6 of the head 4 communicates with longitudinal ducts 7 and 8 of the valve stem through transverse ducts 9 and 10.

According to the invention, the valve stem 1 is obtained directly with its longitudinal ducts 7 and 8 by way of extrusion in such a manner that the ducts are substantially parallel with one another by being for instance arranged symmetrically with respect to the longitudinal axis of the stem 1, as shown in FIG. 1.

The stem 1 is also advantageously obtained by way of extrusion in the form of a round bar of great length, then the bar is cut into sections which are thereafter machined so as to obtain approximately the shape shown in the Figures.

The valve stem 1 may also be obtained by machining a usual round bar in which are drilled at least two parallel longitudinal ducts.

In a first form of embodiment shown in FIG. 1, the longitudinal ducts 7 and 8 are formed by way of extrusion over the whole length of the stem 1, and therefore, each of them opens at the ends 11 and 12 of the stem 1. The longitudinal channels 7 and 8 are naturally closed at the end 12 of the stem 1 by contact of the end 12 with the bottom of the cavity 6 of the valve head 4, and they are obturated at the end 11 of the stem 1 by an additional, substantially cylindrical member 13 assembled thereto and acted upon by the rocker actuating the said valve. In the present case, the additional member 13 has a circular central projection 14 which co-operates with a corresponding rim 15 provided at the end 11 of the stem 1.

In FIG. 3 is shown a variant 13' of the additional member 13 whose end 14' co-operating with the end 11' of the valve head is substantially flat and obturates, in the same manner as a cover, the longitudinal ducts 7' and 8' of the valve head. The member 13 or 13' is assembled to the stem 1 for instance by way of welding.

Another variant is shown in FIG. 3*a*, wherein the two longitudinal ducts 7'' and 8'' of the stem 1'' open at the upper end of the said stem and are each obturated by sealing plugs (not shown) which are for instance screwed into the end bores of the said ducts. In this case, the rocker (not shown) associated with the valve advantageously acts directly upon the end 15'' of the valve stem.

The longitudinal ducts 7 and 8 of the valve stem 1 (or respectively 7' and 8') therefore communicate with the cavity 6 of the valve head 4 through the transverse ducts 9 and 10 and they also communicate with the exterior through transverse ducts 16 and 17 respectively, which are drilled radially into the thickness of the valve stem 1.

The cooling of the valve just described therefore takes place in the following manner. The cooling fluid arrives for instance through the transverse duct 16, passes into the longitudinal duct 7 and flows out into the cavity 6 through the transverse duct 9. Thereafter, the return of the fluid takes place from the cavity 6 into the longitudinal duct 8 through the transverse duct 10, the transverse duct 17 serving for the outflow of the said cooling fluid.

In FIG. 4 there is shown a variant of embodiment of the invention, wherein the valve stem 111 is drilled to form at least two parallel rectilinear longitudinal channels 107 and 108 which open at the end 112 of the stem 101 into a cavity 106 of the valve head 104. In this case, the drilled longitudinal ducts 107 and 108 are blind and do not open at the end 111 of the stem 101. These channels are as before connected to the outside of the stem 101 by transverse ducts 116 and 117 and to the inside of the cavity 106 by transverrse ducts 109 and 110 respectively. The additional member 113 placed at the free end of the valve stem 101 has substantially the same shape as previously.

The transverse ducts 109 and 110 connecting the ducts 107 and 108 with the cavity 106 of the head 104 may have various configurations, such as for instance the one shown in FIG. 5 where it is seen that each longitudinal duct 107 and 108 is connected to the cavity 106 of the head 104 by three transverse conduits 109 and 110 respectively, which extend in planes shifted with respect to one another so as to be superposed to one another without meeting together.

Still another variant of embodiment of the invention is shown in FIG. 6 where the valve stem 201 is provided with four parallel rectilinear longitudinal channels 202 which are arranged so as to be uniformly distributed in the valve stem 201 and which communicate with the central cavity of the valve head (not shown in the drawing) by means of corresponding transverse channels 203. In this case, use may be made of two longitudinal, diametrically opposed channels 202 as intake channels for the cooling fluid and of the two other channels as return channels for the said cooling fluid.

The presence of more than two channels, for instance, of four channels arranged symmetrically about the longitudinal axis of the stem ensures a uniform distribution and balancing of the thermal stresses (due to the difference between the intake temperature and the return temperature of the cooling fluid) affecting the valve stem in order to avoid any thermal deformation, in particular by transverse bending of the latter.

FIG. 7 partially shows a valve stem according to a variant of the invention, wherein two longitudinal rectilinear parallel ducts 307 and 308 are first obtained either by drilling the stem or directly with the stem by way of extrusion, and then the said stem with its ducts is twisted so as to cause the latter to extend helically about the longitudinal axis of the bar forming the stem. In this case, the thermal stresses affecting the valve stem are substantially uniformly distributed along the longitudinal axis of the stem.

Of course, various modifications may be devised for the valves just described without departing from the scope of the invention: in particular, the arrangement and distribution of the longitudinal and transverse channels may be modified, or a valve according to the invention may be obtained whose stem is made from an abrasion-resisting metal and whose head is made from a different metal.

The valve stem 1 is in contact with the internal face of the bottom of the valve head 4, preferably with a certain prestressing bearing pressure in order to support this portion of the valve head during the thermal and pressure stresses to which it is subjected. The bottom of the valve head may be constituted by a wall which is uniform in thickness and, therefore, the mutually opposite faces of which are plane and parallel. However, in order to reduce or avoid the risks of cracking as a result of an excessive concentration of the stresses due to this bearing pressure of the valve stem 1, the wall forming the said bottom of the valve head 4 advantageously comprises a thickened or reinforced central region 18 (FIG. 1) or 118 (FIG. 4) receiving the pressure contact of the valve stem.

It is therefore understood that the invention is by no means limited to the forms of embodiment described and illustrated, which have been given by way of example only. In particular, it comprises all the means constituting technical equivalents to the means described as well as their combinations, should the latter be carried out according to the gist of the invention.

What is claimed is:

1. A fluid cooled valve member construction comprising a hollow head portion and a stem portion connected to said head portion, said stem portion being formed with a plurality of longitudinally extending, spaced, substantially straight bore-like ducts communicating with the inside of said hollow head portion for conveyance of cooling fluid toward the inside of said hollow head portion and reversely outwardly therefrom, said ducts being arranged in pairs of diametrically opposed substantially co-extensive ducts in said stem, at least one pair of said diametrically opposed ducts directing the flow of said fluid in a fluid-feeding direction into said hollow head portion serving thus as fluid feed ducts, and at least a second pair of said diametrically opposed ducts leading flow of said fluid in a reverse direction outwardly of said hollow head portion, said second pair of ducts serving as fluid return ducts, said ducts of said pairs of ducts being uniformly distributed in equal circumferentially spaced relationship about the longitudinal center line axis of said stem portion with feed ducts alternating successively with return ducts.

2. A valve member construction according to claim 1 wherein said stem portion is a body of solid material and wherein said longitudinally extending bore-like ducts are formed directly therein.

3. A valve member construction according to claim 1, wherein said hollow head portion includes a substantially transverse end wall and a threaded opening opposite to and of smaller extent than said transverse end wall, said stem portion being threadedly and sealingly engaged in said opening and projecting inwardly into the hollow head portion with the innermost end of said stem portion in abutting pressure contact with a substantially corresponding central region of said transverse end wall, thereby defining a chamber in said head portion, said bore-like ducts extending to the innermost end of said stem portion and being closed off by said transverse end wall, said stem portion being formed with a plurality of transverse ducts extending laterally in said stem portion inside said chamber and in communication with respective of said bore-like ducts and with said chamber whereby said chamber is in communication with at least one feed bore-like duct and with at least one bore-like return duct.

4. A valve member construction according to claim 3 including a brazing-solder sealing connection between said stem portions and said hollow head portion.

5. A fluid-cooled poppet-valve member construction comprising a hollow head portion and a stem portion connected to said head portion, said stem portion being formed with at least two, spaced, bore-like ducts for conveying cooling fluid, said ducts extending at least partially through and at least approximately longitudinally of said stem portion and communicating with the inside of said hollow head portion and with the outside of said valve member, at least one of said ducts having its center line spaced from the longitudinal axis of said stem portion and extending substantially helically about said axis, at least one duct being a feed duct for supplying fluid to said head portion and at least another duct being a return duct for conveying said fluid back and away from said head portion.

6. A valve member construction according to claim 5, wherein said ducts are directly formed integrally in the body of solid material constituting said stem portion and they extend to and open in the terminal face of at least one end of said stem portion.

7. A valve member construction according to claim 5, including brazing-solder sealing off the connection between said head portion and stem portion.

8. A valve member construction according to claim 5 comprising at least one of said pair of ducts arranged in substantially parallel symmetrical relation to the longitudinal axis of said stem portion.

9. A method of making a stem for a fluid-cooled poppet valve member, comprising the steps of: providing a substantially round rectilinear, rod-like bar element; directly forming said bar element integrally with at least two spaced, at least approximately parallel, substantially straight bore-like ducts extending at least partially through and generally longitudinally of said bar element and opening in the terminal front face of at least one end thereof; and twisting said bar element about its longitudinal axis to cause at least one of said ducts to wind substantially helically about said longitudinal axis.

10. A method according to claim 9, including the steps of making said bar element from substantially cylindrical stock and drilling the same longitudinally from at least one end to form said ducts.

11. A method according to claim 9, consisting in providing said bar element together with said initially straight bore-like ducts in one single step by way of extrusion.

12. A fluid-cooled valve member construction comprising a hollow-head portion and a stem portion connected to said head portion, said stem portion being formed with a plurality of longitudinally extending, spaced, substantially straight bore-like ducts for conveyance toward the inside of said hollow-head portion and reversely outwardly from said valve member of cooling fluid, said ducts being arranged in at least one pair of diametrically opposed substantially co-extensive ducts in said stem, at least each one of said bore-like ducts communicating with at least one transverse duct on the one hand for directing a flow of said fluid in a fluid-feeding direction into said hollow-head portion through at least one of said bore-like ducts thus serving as fluid-feed ducts, and on the other hand for directing a flow of said fluid in a reverse direction outwardly of said hollow-head portion through another of said bore-like ducts thus serving as fluid return ducts, said bore-like ducts being uniformly distributed in equal circumferentially spaced relationship about the longitudinal central axis of said stem portion with feed ducts alternating successively with return ducts.

13. A valve member construction according to claim 12, wherein said hollow-head portion includes a substantially transverse end wall and a threaded opening opposite to and of smaller extent than said transverse end wall, said stem portion being threadedly and sealingly engaged in said opening and projecting inwardly into the hollow-head portion with the innermost end of said stem portion in abutting pressure contact with a substantially corresponding central region of said transverse end wall, thereby defining a chamber in said head portion, said bore-like ducts extending to the innermost end of said stem portion and being closed off by said transverse end wall, selected of said transverse ducts being provided in said stem portion and extending laterally in said stem portion inside said chamber and in communication with respective of said bore-like ducts and with said chamber whereby said chamber is in communication with at least one feed bore-like duct and with at least one bore-like return duct.

14. A fluid-cooled poppet valve member construction consisting of an assembly of at least two component parts tightly connected together and comprising: a hollow mushroom head portion including a substantially transverse end wall and formed with an inner chamber and with a substantially coaxial opening opposite to and of smaller extent than said transverse end wall; and a stem portion secured in sealing relationship to and extending endwise from said head portion; said stem portion consisting of a solid body of material of substantially round rod-like configuration throughout its length extending in tightly engaging relationship through said opening to project bodily into said chamber with one end which is thus enclosed in and surrounded by said chamber, said stem portion being provided with at least two pairs of at least approximately parallel bore-like ducts extending at least partially through and generally longitudinally of said stem portion, each duct being directly formed and entirely defined within said solid body of material and made integral in one piece therewith to serve as a passage-way channel for leading a stream of cooling fluid flowing lengthwise therethrough, each duct communicating on the one hand with said chamber at its end portion located adjacent and inside said chamber and on the other hand with the outside toward its opposite end portion remote from said head portion, both ducts of each pair being substantially diametrically opposed and symmetrical with respect to the longitudinal center line axis of said stem portion so as to be opposite to each other in relation to said center line axis, both ducts of at least one pair of opposite ducts leading said flow of cooling fluid in one same direction whereas both opposite ducts of each remaining pair of ducts are leading said flow of cooling fluid in a same opposite direction so as to thereby provide at least one pair of feed ducts for supplying cooling fluid to said head portion and at least one pair of return ducts for conveying said fluid back and away from said head portion.

15. A valve member construction according to claim 14, wherein at least one of said ducts has its center line spaced from the longitudinal axis of said stem portion and extends helically about said longitudinal axis.

16. A valve member construction according to claim 14, wherein said ducts extend to and open in the terminal face of at least one of said stem portion.

17. A fluid-cooled poppet valve member construction consisting of an assembly of at least two component parts tightly connected together and comprising: a hollow mushroom head portion including a substantially transverse end wall and formed with an inner chamber and with a substantially coaxial opening opposite to and of smaller extent than said transverse end wall; and a stem portion engaging said opening and secured in sealing screw-threaded relationship to and extending endwise from said head portion; said stem portion consisting of a solid body of material of substantially round rod-like configuration throughout its length extending in tightly engaging relationship through said opening to project bodily into said chamber with one end which is thus enclosed in and surrounded by said chamber, said stem portion being provided with a plurality of at least two spaced, bore-like ducts extending at least partially through and generally longitudinally of said stem portion, each duct being directly formed and entirely defined within said solid body of material and made integral in one piece therwith to serve as a passage-way channel for leading a stream of cooling fluid flowing lengthwise therethrough, said stem portion being formed with a substantially flat terminal front face at its inner end abutting endwise with pressure contact against a corresponding substantially flat central region of said transverse end wall of said head portion for supporting and backing said end wall and thereby defining an annular cavity within said chamber, each duct communicating on the one hand with said chamber at its end portion located inside said chamber by opening in said terminal front face of said stem portion where said ducts are closed off by said transverse end wall and on the other hand with the outside towards its opposite end portion remote from said head portion, at least one duct being a feed duct for supplying cooling fluid to said head portion and at least another duct being a return duct for conveying said fluid back and away from said head portion, said stem portion having sidewise and inside said chamber a plurality of transverse ducts opening at one end thereof into said ducts, respectively, and at the opposite end thereof into said chamber, whereby said chamber communicates with each feed duct through at least one transverse outlet duct and with each return duct through at least one transverse inlet duct.

18. A valve member construction according to claim 17, including brazing-solder sealing off the connection between said head portion and stem portion.

19. A valve member construction according to claim 17 wherein said ducts extend to and open in the terminal face of at least one end of said stem portion.

* * * * *

UNITED STATES PATENT AND TRADEMARK OFFICE

CERTIFICATE OF CORRECTION

PATENT NO. : 3,945,356
DATED : March 23, 1976
INVENTOR(S) : Karl Walter Kuhn

It is certified that error appears in the above–identified patent and that said Letters Patent are hereby corrected as shown below:

Column 7, line 36, (claim 16, line 3) insert: ---end--- after "one"

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*